US006609341B2

(12) United States Patent
Maylon et al.

(10) Patent No.: US 6,609,341 B2
(45) Date of Patent: Aug. 26, 2003

(54) CONTOURED STUCCO REVEAL

(75) Inventors: Gary Joseph Maylon, Trussville, AL (US); Gary James Chenier, Jr., Winter Haven, FL (US); Michael Wade Goodwin, Lakeland, FL (US); Melvin J. Kurpinski, Ft. Lauderdale, FL (US)

(73) Assignee: Alabama Metal Industries Corp., Birmingham, AL (US)

( * ) Notice: Subject to any disclaimer, the term of this patent is extended or adjusted under 35 U.S.C. 154(b) by 0 days.

(21) Appl. No.: 10/007,249

(22) Filed: Nov. 13, 2001

(65) Prior Publication Data

US 2002/0124504 A1 Sep. 12, 2002

Related U.S. Application Data

(60) Provisional application No. 60/253,511, filed on Nov. 28, 2000.

(51) Int. Cl.[7] ..... E04B 2/00

(52) U.S. Cl. ..... 52/367; 52/371; 52/364; 52/468; 52/699; 52/717.03; 52/465

(58) Field of Search ..... 52/371, 364, 468, 52/665, 701, 699, 318, 717.03, 465

(56) References Cited

U.S. PATENT DOCUMENTS

| | | | | | |
|---|---|---|---|---|---|
| D26,201 | S | | 10/1896 | Turner | |
| 1,170,968 | A | | 2/1916 | Elgin | |
| 1,204,955 | A | | 11/1916 | Day | |
| 2,151,605 | A | * | 3/1939 | Lavering | 52/396.04 |
| 2,272,762 | A | | 2/1942 | Awbrey | |
| 3,375,623 | A | * | 4/1968 | Buhler | 52/97 |
| 3,383,818 | A | | 5/1968 | Tatum | |
| 3,606,714 | A | | 9/1971 | Arnett | |
| 3,667,174 | A | | 6/1972 | Arnett | |
| 3,964,220 | A | | 6/1976 | Rutkowski et al. | |
| 4,651,488 | A | | 3/1987 | Nicholas et al. | |
| 4,785,601 | A | * | 11/1988 | Tupman | 52/364 |
| 5,063,720 | A | | 11/1991 | Bifano et al. | |
| 5,263,294 | A | | 11/1993 | Koenig et al. | |
| D344,596 | S | | 2/1994 | McArthur | |
| 5,423,154 | A | | 6/1995 | Maylon et al. | |
| 5,579,623 | A | | 12/1996 | Stark et al. | |
| 5,761,866 | A | | 6/1998 | Maylon | |
| 5,956,912 | A | * | 9/1999 | Carter et al. | 52/396.02 |

* cited by examiner

*Primary Examiner*—Carl D. Friedman
*Assistant Examiner*—Steve Varner
(74) *Attorney, Agent, or Firm*—Alston & Bird LLP

(57) ABSTRACT

A stucco reveal system that can be assembled in a pattern which defines visual breaks between panels of applied stucco. The stucco reveal system includes individual strips of contoured stucco reveal constructed of extruded vinyl or metal that have the qualities of easy installation and cleaning and aesthetic desirability. The contoured reveal strips include a floor to which a pair of contoured walls are attached. The inside surfaces of the floor and contoured walls define a channel which forms the visual break between stucco panels. The shape of contoured walls are defined in part by an arc portion, an angled straight wall portion or a partial bevel portion. The contoured walls have a vertical component that makes them easily visible for cleaning and reflects cleaning water spray out of the channel, reducing soiling of the grid due to cleaning and rain runoff. The top edges of the contoured walls act as guides during stucco application for a screed stucco surface.

12 Claims, 7 Drawing Sheets

CONTOURED STUCCO REVEAL

CROSS-REFERENCE TO RELATED APPLICATION

The present application claims priority from U.S. Provisional Application No. 60/253,511 entitled "Contoured Stucco Reveal" and filed on Nov. 28, 2000, the contents of which are incorporated herein by reference.

FIELD OF THE INVENTION

The present invention relates to the use of stucco-reveal strips in building construction. More specifically, the present invention relates to a stucco-reveal strip that includes contoured walls for improved installation, maintenance and aesthetics.

BACKGROUND OF THE INVENTION

Stucco reveal accessories are used on stucco surfaces to provide an architectural relief. For example, stucco reveal products are often used to divide a normally plain stucco surface of large dimensions into a grid of smaller sections. Unlike brick, block, glass block or shingles, the stucco is applied homogeneously across entire building walls. Although stucco is often applied in a small repeating pattern, this pattern is not normally visible from a distance. Thus, the stucco appears to the passerby to be a plain wall of a single color which lacks aesthetic appeal.

One prior art stucco reveal product is in the form of an extruded strip. The extruded strip includes a pair of straight walls with a flat backing that are integrally formed by an extrusion process. The flat backing includes a series of holes through which fasteners can be driven for attachment to a subsurface such as wood, brick or cinder block. The straight wall structure runs the length of the extruded strip and is at right angles to the flat backing, thereby forming a straight-walled channel. The exterior surfaces of the channel walls include a bead which becomes embedded in the stucco as it is applied. This serves to strengthen the interface between the stucco and the exterior surface of the stucco reveal strip.

Installation of the stucco reveal strip is generally straightforward, requiring a worker to nail, screw, or staple the strip to a subsurface material. Intersections between strips are joined by cutting mitered joints or using a pre-assembled connection system. See, U.S. Pat. No. 5,761,866, which is assigned to the assignee of the present application and incorporated herein by reference. The strips are applied by placing the pre-assembled joints at desired locations and then interconnecting the joints with sections of the stucco reveal strip. Once the stucco reveal strip is attached to the subsurface, the stucco itself is spread on the subsurface in coats within the grid defined by the stucco reveal strips and other stucco accessories such as casing beads, corner beads and expansion joints. The stucco is applied within the grid up to the wall structure of the stucco reveal strip, covering the bead on the outer surface of the wall structure. The top of the reveal structure serves as a screed to assure proper thickness and a level surface for the applied stucco.

Conventional channel designs may require cleaning. As outdoor wall surfaces get dirty, they must be cleaned to maintain the aesthetic appeal of the architecture. With conventional stucco reveal strips that are placed horizontally, the lower of the channel walls creates a horizontal shelf that can collect dirty rainwater. Over time, the strip can thus become soiled and unsightly. Typically, cleaning is performed using a power-washer that sprays a combination of water and cleansing agent on the stucco wall and stucco reveal strip. The straight walls of the stucco reveal strip require the close attention of the sprayer. Failure to spray the reveal strip from a sharp angle (so that the spray hits the inside surface of the walls head-on) will reduce cleaning effectiveness. Spraying from a sharp angle is difficult as the power-washer gun is heavy, attached to hoses and a power cord and must be used from a distance.

Cleaning the conventional stucco reveal strip by hand is also problematic. Wiping heavy dirt and grease from a strip requires significant time and effort because of the awkward angle required to access the inside surfaces of the straight walls. This awkward angle makes it difficult to apply pressure on the inside surfaces with a sponge or brush. As with rainwater, runoff from the cleaning process tends to stay within the channel formed by the straight walls. Instead of cleaning, this merely redistributes much of the dirt to other surfaces in the stucco reveal strip. Also, caulking at the joints of a reveal structure can deteriorate and leak. Water that stays on the bottom ledge of the reveal can leak into the wall cavity through these joints. Thus, an improved wall shape is needed that stays cleaner in normal environmental conditions and that also reduces the effort of cleaning the stucco reveal strip.

SUMMARY OF THE INVENTION

The present invention addresses the above needs and achieves other advantages by providing a reveal strip for stucco reveal panels or other wall materials such as gypsum boards, in which the reveal strip has a number of features yielding functional as well as aesthetic benefits. The reveal strip includes a pair of contoured walls spaced across a floor that defines a smooth, attractive channel surface. The contoured walls are angled away from each other and extend outwards, allowing the stucco to be applied underneath the walls for a firm attachment to a structural base. The reveal strips are integrally formed of extruded material for easy assembly and improved leak resistance. The integral construction also provides smooth channel surfaces for improved appearance of the reveal strip.

In one embodiment, the reveal strip comprises an elongate strip of material. The elongate strip of material preferably is manufactured by extrusion so as to have a constant cross-section. The elongate strip defines a channel and a pair of fixation flanges. The channel includes a floor and a pair of spaced walls that define a plurality of inner surfaces of the channel. The floor integrally connects the spaced walls and the pair of spaced walls extend generally away from each other in a laterally outward direction. Extending laterally outwards from, and fixed to, the channel are the pair of fixation flanges. The fixation flanges are configured so as to be embeddable in adjacent stucco portions of the structure. Embedding of the fixation flanges into the stucco conceals all but the inner surfaces of the channel walls and floor which define the visual breaks between the stucco reveal portions of the structure. Preferably, but not necessarily, the floor and flanges collectively form a continuous substantially planar base that is mounted on the substructure of a building wall.

In an embodiment useful for defining breaks between gypsum boards, each flange is fixed to a respective one of the spaced walls and extends laterally outwards from the wall. The flanges are fixed to the adjacent gypsum boards by taping and mud application. Alternatively, the flanges may be attached to a bottom portion of the respective one of the spaced walls and extend outwards from the bottom portion.

Such positioning of the fixation flanges allows them to be attached to a substructure with fasteners and sealed under the applied stucco. Optionally, the flanges may define a plurality of fixation holes that are configured to receive fasteners for easier attachment.

The outwardly extending walls of the channel can have various forms. For instance, the walls may have an arc contour, or may be substantially planar and angled away from each other, or may be partially beveled having upper angled portions extending away from each other. The contoured shape of the outwardly extending walls allows stucco to be applied up to, and under, the walls. A bead strip may be attached to a top edge of each of the contoured walls and may extend downwards from each of the contoured walls.

The present invention has several advantages. The outwardly extending, contoured walls provide an anchor for the applied stucco. Water retention in the channel is less likely due to its contoured inner surfaces, which also makes cleaning of the channel much easier. The use of an extruded strip with a constant cross-section means that joints and the attendant risk of leaks are minimized in constructing the stucco reveal grid. The bead extending downwards from each of the walls further strengthens the attachment of stucco to the strip and prevents water leakage between the strip and stucco. The fixation flanges are positioned for easy attachment of the reveal to the base structure. Especially useful are the plurality of fixation holes defined by the fixation flanges that receive fasteners for a firm attachment of the reveal strip to the base.

BRIEF DESCRIPTION OF THE DRAWINGS

Figure 1:
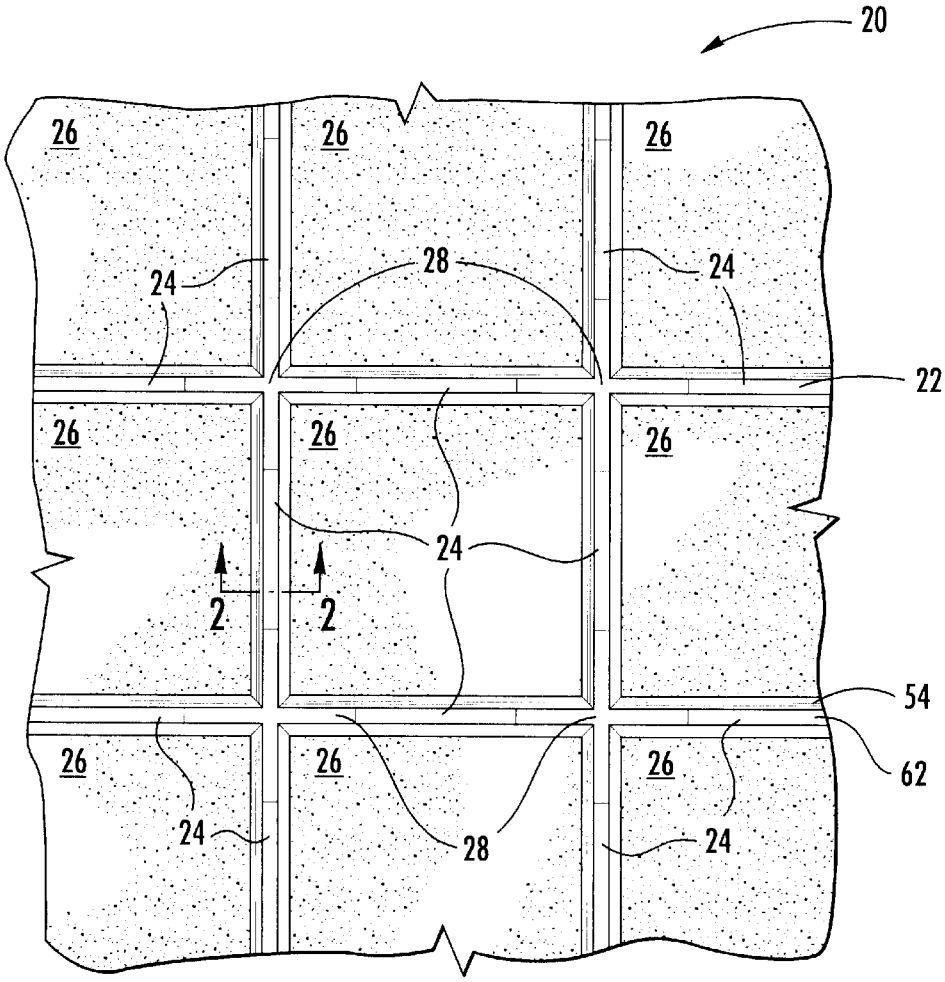
Figure 2:
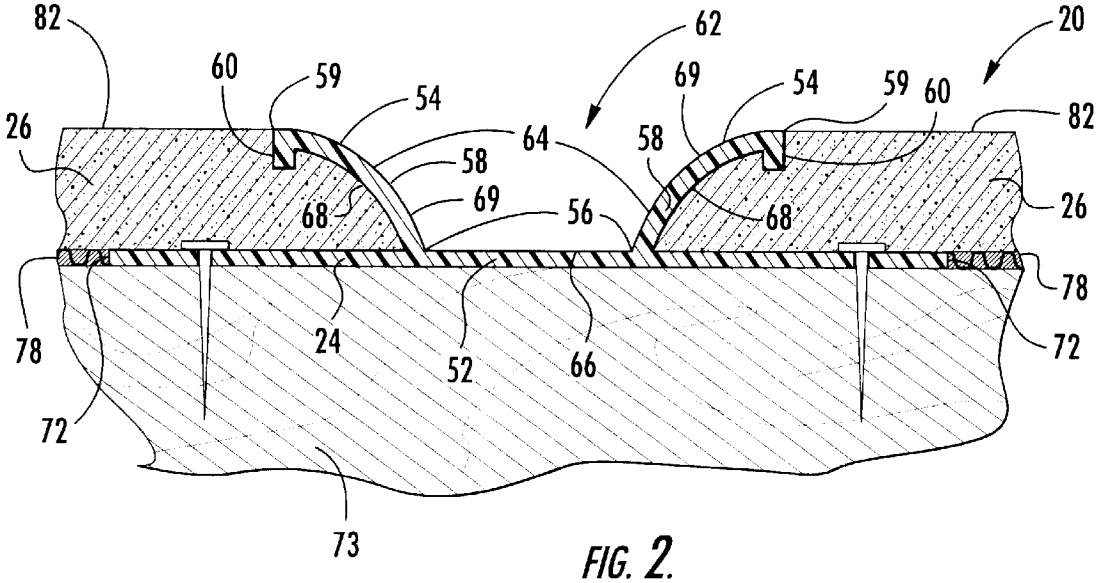
Figure 3:
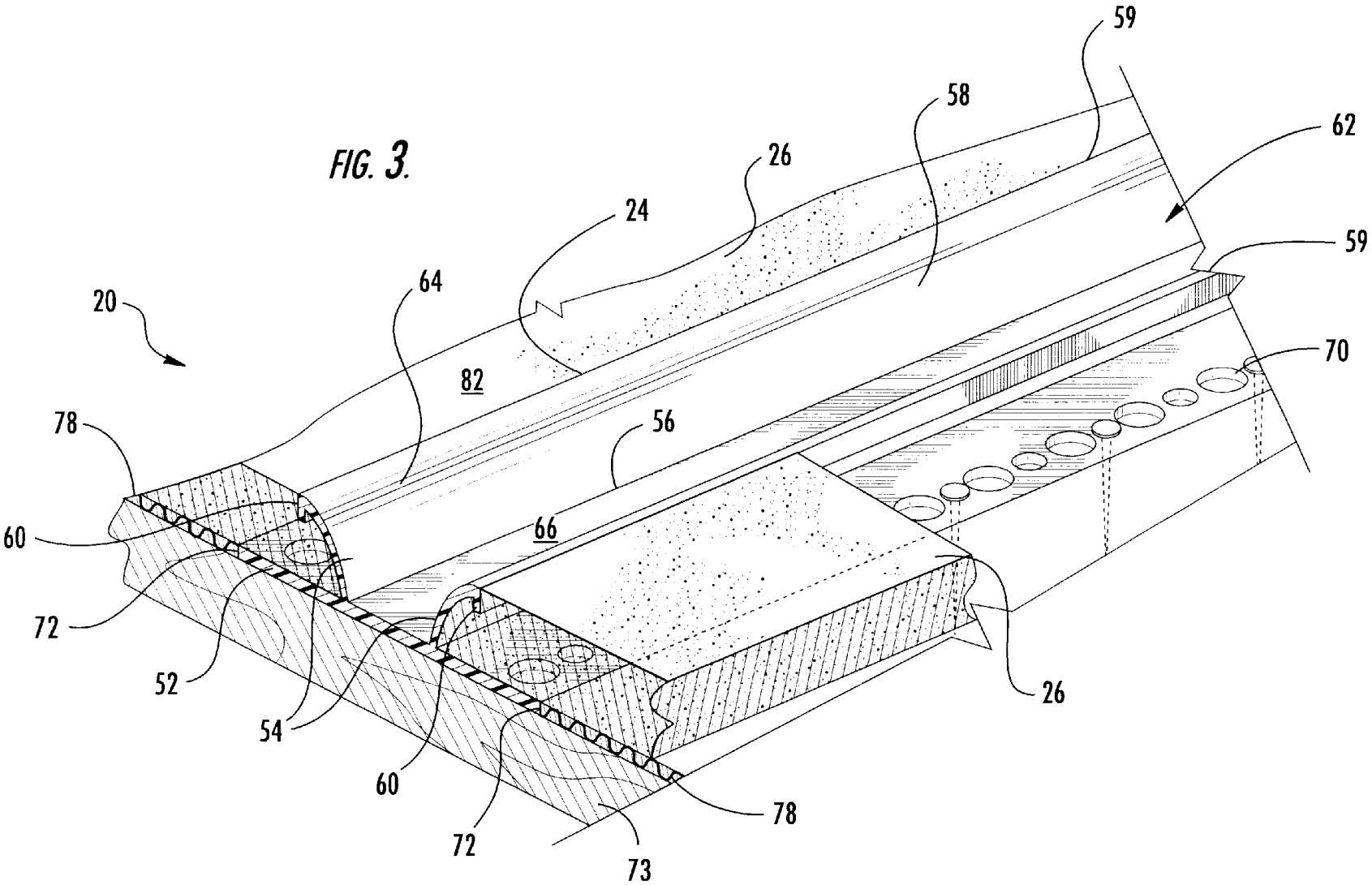
Figure 4:
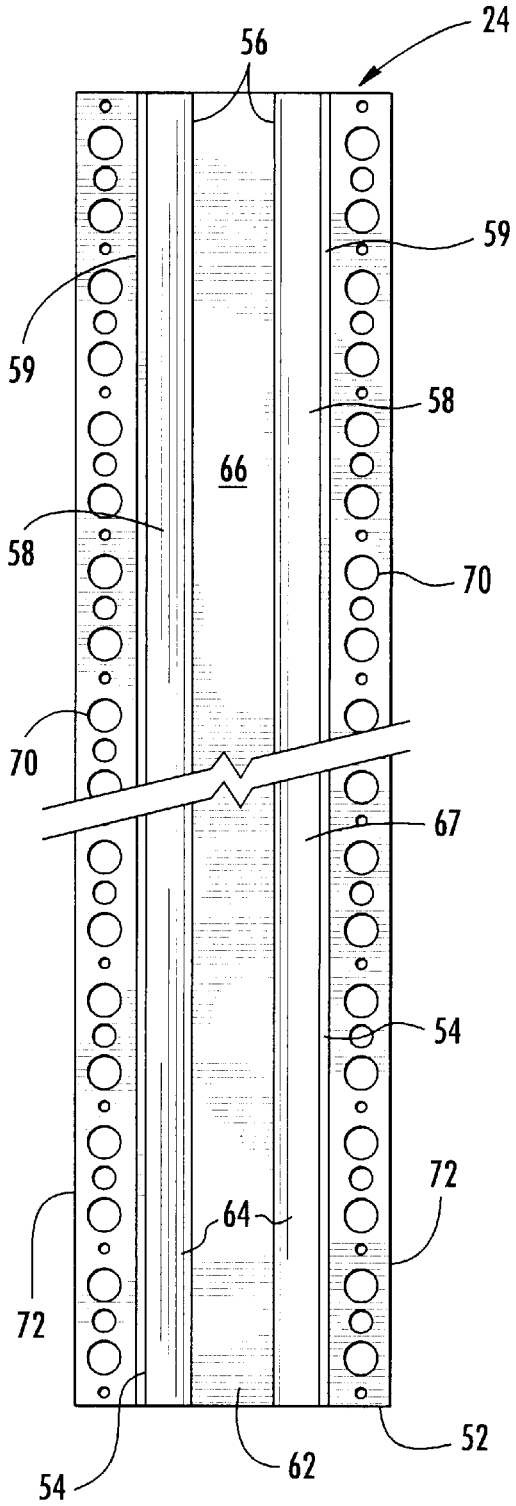
Figure 5:
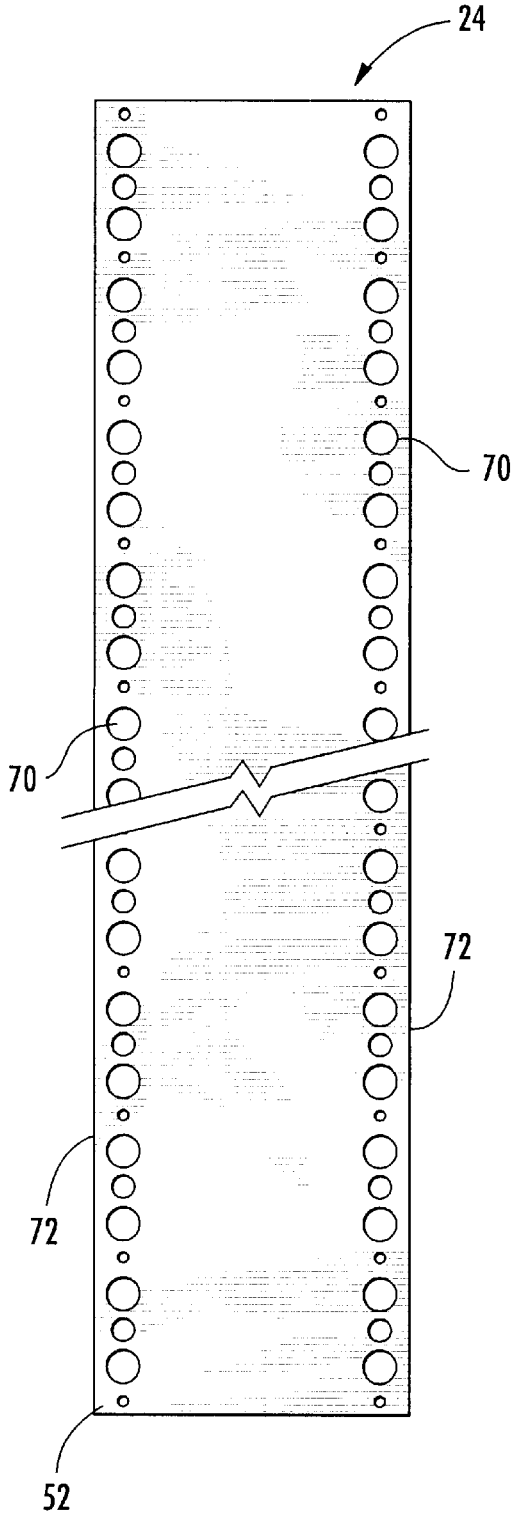
Figure 6:
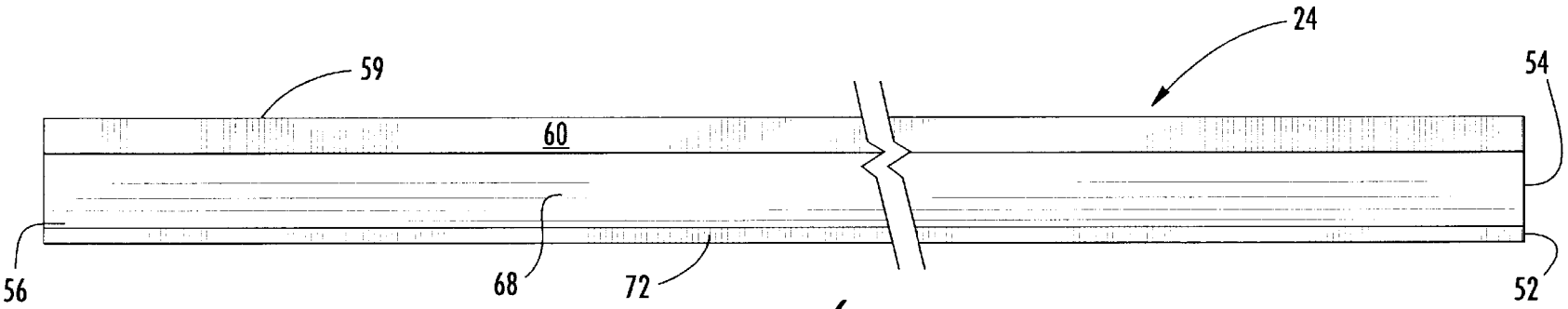
Figure 7:
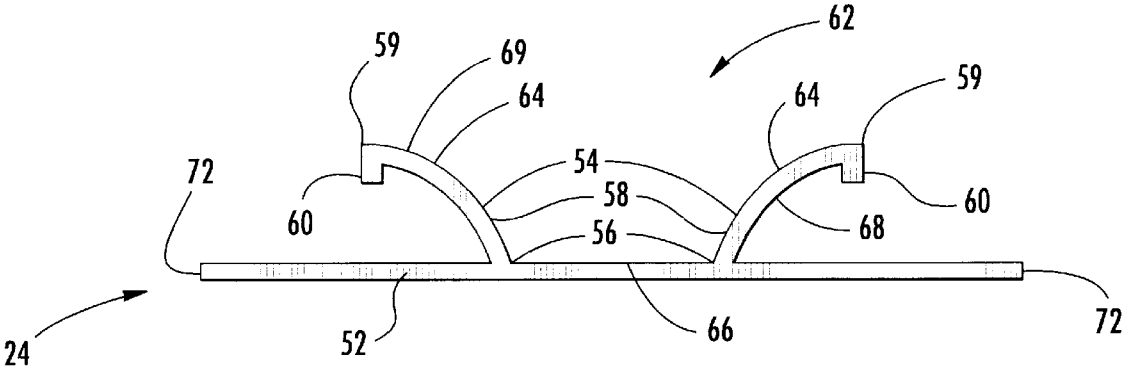
Figures 8, 9:
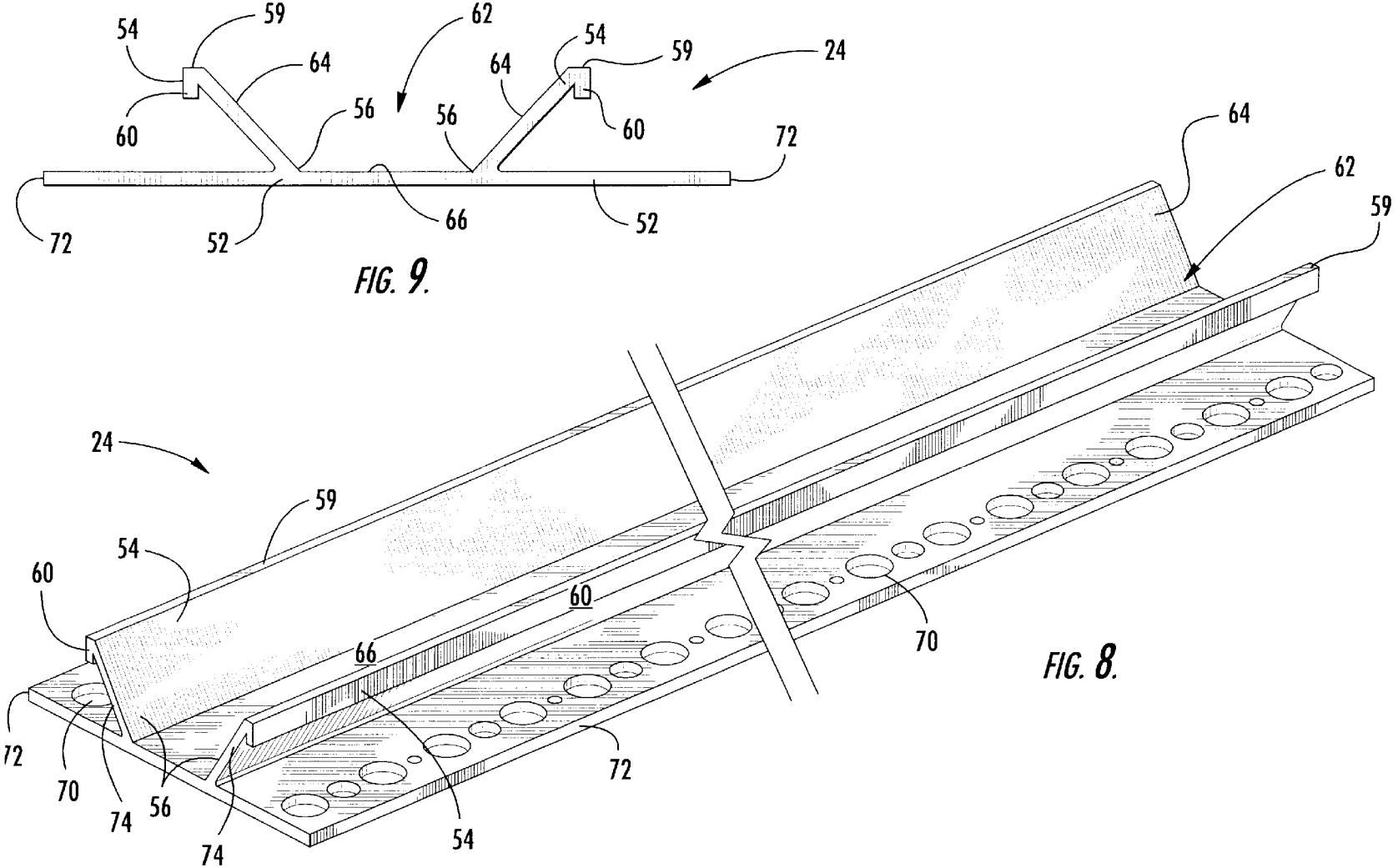
Figure 11:
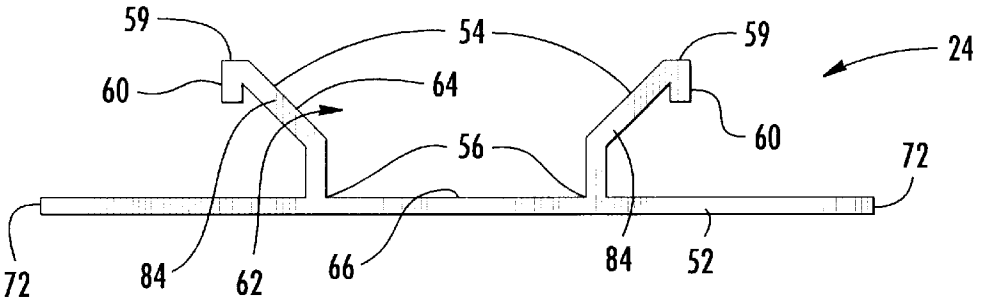
Figure 10:
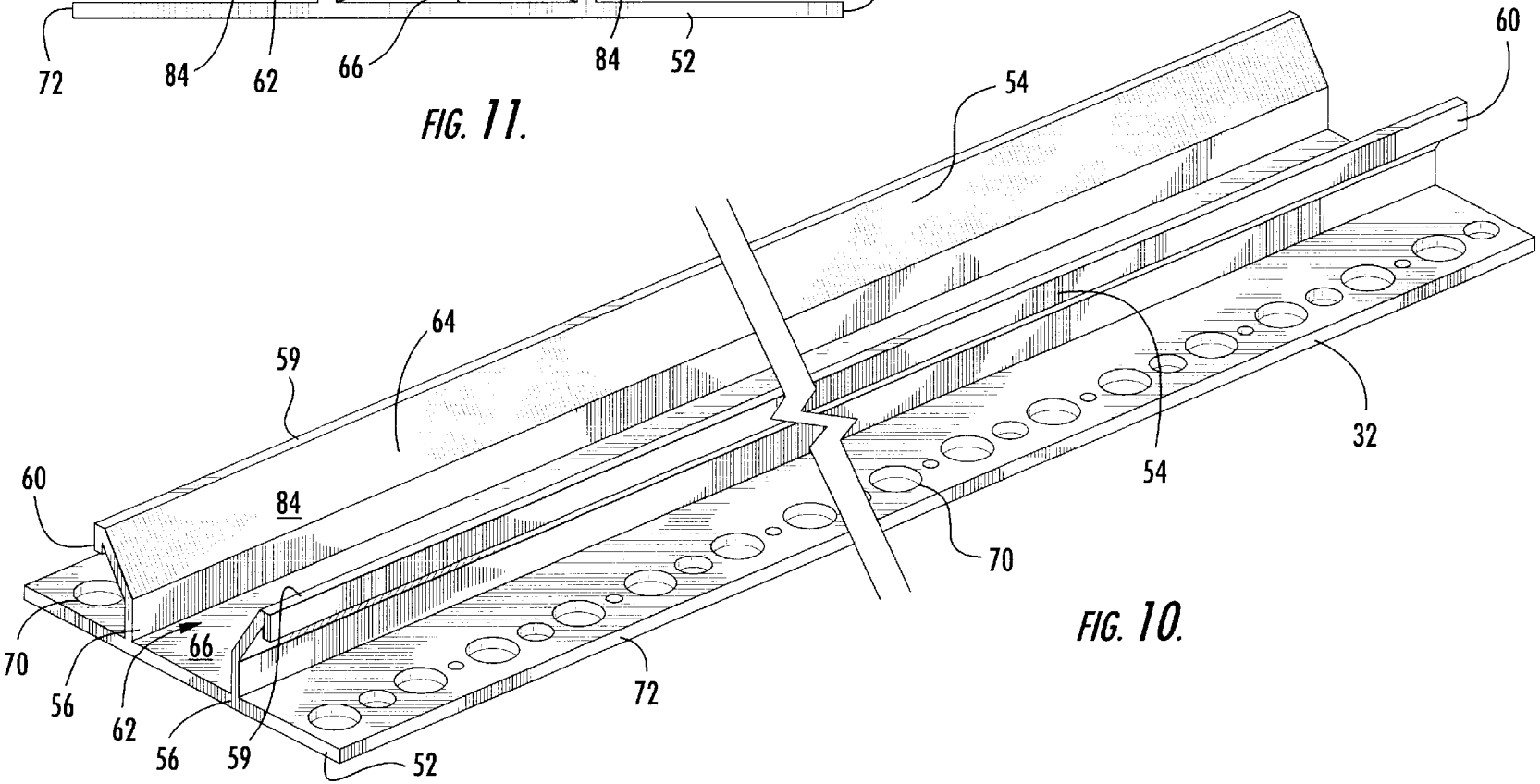
Figure 12:
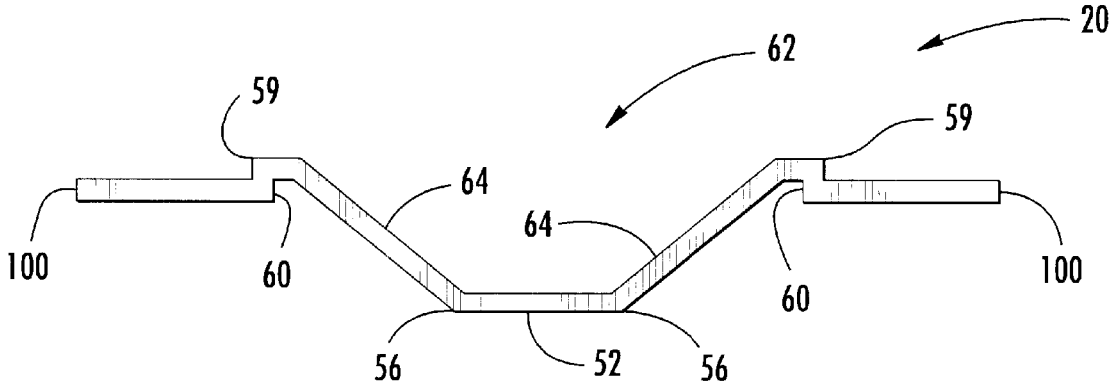
Figure 13:
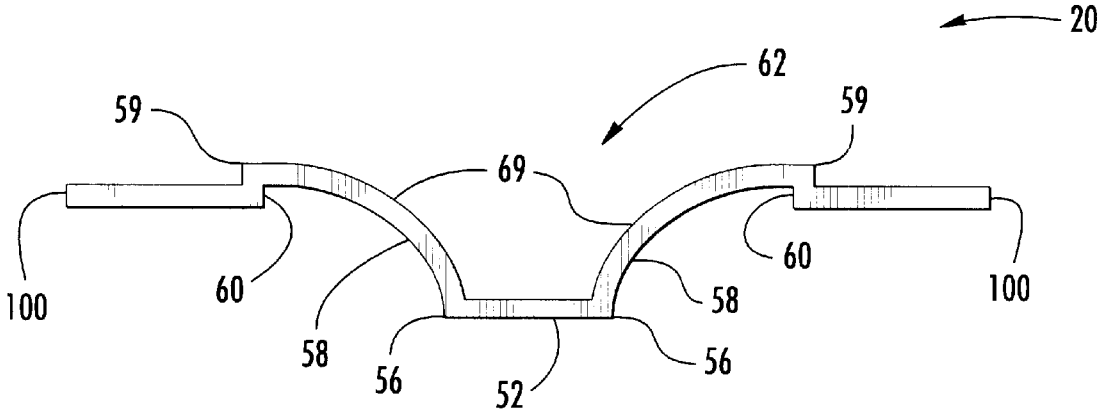

Having thus described the invention in general terms, reference will now be made to the accompanying drawings, which are not necessarily drawn to scale, and wherein:

FIG. 1 is a partial, fragmentary, perspective view of a representative stucco construction employing a contoured stucco reveal in a grid pattern;

FIG. 2 is a fragmentary, elevation view taken along line 2—2 in FIG. 1 showing a cross-section of the stucco construction;

FIG. 3 is a fragmentary, perspective view of an installed contoured stucco reveal strip including an arc wall portion;

FIG. 4 is a top, plan view of the contoured stucco reveal strip that includes an arc wall portion as shown in FIG. 3;

FIG. 5 is a bottom, plan view of the contoured stucco reveal strip that includes an arc wall portion as shown in FIG. 3;

FIG. 6 is a side, elevation view of the contoured stucco reveal strip that includes an arc wall portion as shown in FIG. 3;

FIG. 7 is a cross-sectional, elevation view of the contoured stucco reveal strip that includes an arc wall portion as shown in FIG. 3;

FIG. 8 is a perspective view of a contoured stucco reveal strip that includes a straight wall portion;

FIG. 9 is an elevation view of a cross-section of the contoured stucco reveal strip including a straight wall portion as shown in FIG. 8;

FIG. 10 is a perspective view of a contoured stucco reveal strip that includes a partial bevel wall portion;

FIG. 11 is an elevation view of a cross-section of the contoured stucco reveal strip including a partial bevel wall portion as shown in FIG. 10;

FIG. 12 is an elevation view of a cross-section of a contoured drywall reveal strip that includes a straight wall portion; and FIG. 13 is an elevation view of a cross-section of a contoured drywall reveal strip that includes an arc wall portion.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to FIG. 1, a stucco construction 20 is shown in a diagrammatic form to illustrate the grid pattern 22 that can be constructed using the current invention. Individual strips of contoured stucco reveal 24 form the lines of the grid pattern 22 by separating the panels of applied stucco 26. Intersections between the strips of contoured stucco reveals 24 are formed by cutting and joining matching angled pieces with a miter saw at the work site, or by using the pre-assembled intersections 28 as demonstrated in U.S. Pat. No. 5,761,866. Other configurations than a grid can be also be used, such as single or multiple horizontal or vertical lines.

The grid pattern 22 is an aesthetic improvement over the traditional blank stucco wall due to the stucco panels 26. Closer inspection reveals that the contoured walls 52 of the individual stucco reveal strips 24 present a smooth surface unlike the straight-walled variety. This is a variation that gives a more finished look to the stucco construction 20 and eliminates the harsher angles of straight-walled stucco reveal strips.

FIGS. 3 through 12 illustrate the various contoured wall structures of three preferred embodiments. Note, however, that other embodiments of contoured wall structure inventions are also possible and this list is not meant to be limiting. FIGS. 3 through 8 depict a first embodiment of the contoured stucco reveal invention. FIG. 3 depicts a perspective of a cross-section and partial break away of the stucco construction 20 including a contoured reveal strip 24. The contoured reveal strip 24 includes a base 52 and a pair of walls 54. FIG. 4 shows a plan view of the top, FIG. 5 a plan view of the bottom, FIG. 6 an elevated side view, and FIG. 7 an elevated cross-sectional view of the same reveal strip 24. The pair of walls 54 are parallel to each other and run the length of the contoured reveal strip 24 and therebetween define a channel 62. The pair of walls 54 are centered on the base 52, making the contoured reveal strip 24 symmetrical about its vertical axis. The spacing and positioning of the pair of walls 54 could be varied for different methods of stucco application, but the centered position is the most useful in standard stucco constructions 20 (such as the one shown in FIG. 1) because the reveal strip can be cut and pieced together at varying angles.

The pair of walls 54 include a bottom wall portion 56, an arc portion 58, a top edge 59 and a bead 60, each of which run the length of the contoured reveal strip 24. Extrusion is the preferred method of construction of the contoured reveal strip 24 because of its symmetry along its long axis and strip construction. The contoured reveal strip 24 is preferably made up of a plastic (e.g., vinyl) or malleable metal (e.g., aluminum) that is light, durable, easy to manipulate by cutting and hence easy to install and maintain. It should also be noted that the contoured reveal strip 24 will be commonly used on outdoor surfaces directly exposed to the elements, so a material that resists fading and corrosion (e.g., both vinyl and aluminum) is also preferable.

The bottom wall portion 56 serves as the connection between the arc portion 58 and the base 52. Preferably, the bottom wall portion 56 is integrally formed with a connection to base 52 during an extrusion process, thereby avoiding the need for later attachment. The arc portion 58 is preferably an arc of thin extruded material which extends away from the base portion 52 at an angle of approximately 45° thereto and forms the contoured shape of one of the pair of walls 54 of the first embodiment. The concave side 68 of each arc portion 58 points toward the base 52, while the convex side 69 points away from the base 52. The bead 60 is an abbreviated wall structure that protrudes downward from the top edge 59 of the arc portion 58 in the direction of the base 52. The bead 60 and the arc portion 58 provide a gripping surface for the installed stucco panel 26. The top edge 59 allows the creation of a screed surface during stucco application.

Other arc shaped configurations are possible for the arc portion 58, depending upon the preferred shape, style and function of the channel 62 and the ability of the walls 54 to aid the application of stucco to create the stucco panels 26. For instance, the radius of arc portion 58 could be increased while retaining the 90° arc length and the 45° angle with respect to the base 52 if a different visual appeal or thickness of stucco application is desired.

The base 52 includes a series of holes 70 along each outer edge 72 that allow contoured reveal strip 24 to be fastened to a sheathing material 73 and to provide space for the interdigitation of stucco. The holes 70 are of varying diameters, with the smaller diameter holes sized to receive a range of different fasteners and the larger holes sized to allow an improved grip at the stucco interface. In the plan view of FIG. 4, it can be seen that base 52 is much wider than the pair of walls 54.

The channel 62 includes a pair of side surfaces 64 and a floor 66. Side surfaces 64 are defined by the configuration of the walls 54. In the first embodiment, the shape of side surfaces 64 is dictated by the convex side 69 of the arc portion 58 to have a smooth, rounded contour shape that curves inward until it hits floor 66. The shape and appearance of the channel 62 is of critical importance as it comprises the visible portion of the contoured reveal strip 24 after stucco application is completed. Also, the shape of the channel 62 dictates the ease of installation and cleaning of the contoured reveal strip 24. Thus, the second and third embodiments include variations of the arc walls 54 that define the channel 62.

FIG. 3 is a broken, perspective drawing of the installed contoured reveal strip 24 and FIG. 2 is an elevated cross-section of the same installed contoured reveal strip. The reveal strip 24 is installed by attachment to an underlying sheathing material 73. In turn, the sheathing material 73 is attached to a structural support made of wood or metal (not shown). The lath material 78 is attached over the sheathing material 73 in accordance with general stucco construction techniques, which may include (but which is not shown here) a portion of the lath material 78 lying on top of the base 52. The plaster or stucco 26 is then applied to the lath material 78 in one or more layers up to the walls 54. The top edge 59 of the walls 54 form a screed edge which defines a face surface 82 of the resulting stucco construction. As such, the channel 62 defines the visual break, shown in FIG. 1 as the grid pattern 22, in the stucco construction 20.

As mentioned above, one advantage of the contoured stucco reveal is the ease of cleaning the channel 62. Both of the arc portions 58 have a significant vertical component when installed so that the channel side surfaces 64 can be reached easily with a sponge or a power washer. Also, the channel side surfaces 64 are much easier to see because they are angled toward the viewer. Finally, secondary water spray off of the channels 62 has much more clearance to deflect outward and avoid being trapped. Note that this action is also useful during runoff of rainwater, in that the rainwater is not trapped by the straight edges and flat wall surfaces of a conventional stucco reveal. Trapped rainwater that is left standing may result in water intrusion or a leak at the joints of the reveal structure, especially if those joints are not well-maintained.

FIGS. 8 and 9 depict a second embodiment of the current invention, where the pair of walls 54 include a straight wall portion 74 in place of the first embodiment's arc portion 58. FIG. 8 shows a perspective view and FIG. 9 a cross-sectional view of the second embodiment. The straight wall portion 74 extends at a 45° angle with respect to the base 52, which forms a bevel in this second embodiment of the contoured reveal strip. Changing an arc to a straight bevel produces a difference in the shape and characteristics of the channel 62. The straight wall portion 74 is even more likely to reflect water spray out of the channel 62 because the channel side surfaces 64 are now flat. They are also even easier to visually inspect for that reason.

The straight wall portion 74 may be varied from a 45° angle in other embodiments. Smaller angles with respect to the base 52 would give a more flattened appearance to the channel 162 and be much easier to clean, but would cut down on the thickness of the stucco to be applied. Larger angles would eventually approach the configuration of the conventional prior art and much of the advantage in cleaning, installation and appearance would be lost. One alternative would be to combine a smaller angle with a longer wall portion 74 which would allow the same thickness of stucco to be applied while giving a different visual impression.

FIGS. 10 and 11 depict a third embodiment of the current invention, where the pair of walls 54 include a chamfered or partial bevel portion 84 in place of the first embodiment's arc portion 58. FIG. 10 shows a perspective view and FIG. 11 a cross-sectional view of the third embodiment. The partial bevel portion 84 has a dog-leg, or hooked, shape that is straight and at 90° to the base 52 on the bottom and beveled at 45° with respect to the base at the top.

The partial bevel portion 84 combines the advantages of the second embodiment but with a smaller channel 62 width. The channel 62 still includes the side surfaces 64 and the floor 66, but the side surfaces 64 have a smaller component in the horizontal direction due to the fact that the chamfer shape is only a partial bevel. This is particularly advantageous for smaller grids where the channel 62 must be shrunk to keep the stucco panels 26 to a reasonable size. Note too, the partial bevel portion 84 retains the advantage of securing the edges of the stucco during application and cleaning will still be easier than the traditional straight walled stucco reveal strips.

As mentioned above, all three embodiments are preferably constructed of an extruded material such as vinyl or metal. Vinyl strips have the advantage of light weight, flexibility and low cost construction. Metal lends greater structural integrity, but as the reveal strip 24 is not a structural load bearing member, greater structural integrity is usually not necessary. The reveal strip 24 can also be constructed of a combination of separately extruded materials, or even non-extruded materials such as roll-formed steel.

The contoured stucco reveal can also be used on a range of wall surfaces to provide the same visual break between panels. For example, the reveal can be used with sheet rock or drywall, as shown in FIGS. 12 and 13. The drywall variants apply to all three stucco embodiments, but have slightly thinner and lighter profiles to accommodate gypsum board thicknesses. The drywall reveals differ from the previous embodiments in that the base 52 extends only as far as the bottom wall portion 56. The reveal strip 20 is secured by a pair of drywall tabs 100 in lieu of the base 52. The drywall tabs 100 each extend horizontally off of the bead 60, and, as part of the extruded shape, extend the length of the reveal strip 20. Each drywall tab 100 is recessed slightly from top edge 59 to allow for taping and mud application during installation. This allows the mud to be leveled with the top edge 59 of the reveal strip 20. Taping and mud application secures the drywall tabs 100 and the reveal strip 20 in place and provides an aesthetically appealing, smooth surface at the interface between the reveal strip 20 and the drywall. Also, the channel 62 retains the same aesthetic appeal and ease of cleaning as it does for stucco walls. The fixation of the drywall tabs 100 could also be reinforced using nails, screws, staples or other fasteners before the application of mud and tape.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A reveal strip for assembly into a reveal pattern that provides visual breaks between adjacent portions of a structure, the reveal strip comprising:

an elongate strip of extruded material comprising:

a channel including a floor and a pair of spaced walls integrally joined to and spaced across the floor, at least portions of the spaced walls extending outwards away from each other, said floor and spaced walls defining a plurality of inner surfaces of the channel; and a pair of fixation flanges fixed to opposite sides of the channel and extending outwards from the channel so as to be embeddable into adjacent portions of the structure;

whereby embedding of the fixation flanges into the adjacent portions of the structure conceals all but the inner surfaces of the channel which define the visual breaks between the portions of the structure.

2. A reveal strip as in claim 1, wherein each of the flanges is fixed to a respective one of the spaced walls and extends outwards therefrom.

3. A reveal strip as in claim 1, wherein each of the flanges is attached to a bottom portion of a respective one of the spaced walls and extends outwards therefrom.

4. A reveal strip as in claim 1, wherein each of the flanges is attached to a top edge of a respective one of the spaced walls and extends outwards therefrom.

5. A reveal strip as in claim 1, wherein the spaced walls each includes a top edge defining a bead configured to retain the adjacent portions of the structure.

6. A reveal strip as in claim 1, wherein the spaced walls have an arc contour.

7. A reveal strip as in claim 1, wherein the spaced walls are angled, straight walls.

8. A reveal strip as in claim 1, wherein the spaced walls are partially beveled.

9. A reveal strip as in claim 1, wherein the pair of fixation flanges define a plurality of fixation holes, each fixation hole configured to receive a fastener.

10. A method of assembling a plurality of reveal strips as part of a structure so as to provide a visual break between portions of the structure, the method comprising:

positioning the reveal strips in a predetermined pattern on a base of the structure so as to define a plurality of open spaces between the reveal strips;

fastening the reveal strips to the base of the structure;

applying a stucco material onto the base of the structure in the open spaces; and creating an interlocking engagement between the stucco material and the reveal strip by applying the stucco material up to and under a pair of spaced, outwardly inclined walls of the reveal strip that are spaced across a floor to define a channel of the reveal strip.

11. A method of assembling as in claim 10, wherein fastening includes fastening a pair of fixation flanges of the reveal strip to the base of the structure.

12. A method of assembling as in claim 11, wherein creating includes applying stucco under a bead extending from each of the outwardly contoured walls.

* * * * *